US011940259B2

(12) United States Patent
Schroeder et al.

(10) Patent No.: US 11,940,259 B2
(45) **Date of Patent: *Mar. 26, 2024**

(54) MULTI-FACETED SHOT

(71) Applicant: Federal Cartridge Company, Anoka, MN (US)

(72) Inventors: Matthew S. Schroeder, Princeton, MN (US); Adam J. Moser, Big Lake, MN (US); Drew L. Goodlin, Isanti, MN (US); Erik K. Carlson, Oak Grove, MN (US)

(73) Assignee: Federal Cartridge Company, Anoka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/074,193

(22) Filed: Dec. 2, 2022

(65) Prior Publication Data

US 2023/0168070 A1 Jun. 1, 2023

Related U.S. Application Data

(63) Continuation of application No. 17/162,848, filed on Jan. 29, 2021, now Pat. No. 11,519,703.

(51) Int. Cl.
*F42B 7/04* (2006.01)

(52) U.S. Cl.
CPC ..... *F42B 7/046* (2013.01)

(58) Field of Classification Search
CPC ..... F42B 7/046; F42B 7/04
USPC ..... 102/448, 457, 459, 460
See application file for complete search history.

(56) References Cited

U.S. PATENT DOCUMENTS

| | | | | | |
|---|---|---|---|---|---|
| 1,583,559 | A * | 5/1926 | Kenneweg | F42B 7/046 | 102/460 |
| 2,394,524 | A | 2/1946 | Pasehke et al. | | |
| 3,123,003 | A | 3/1964 | Tange, Jr. et al. | | |
| 3,579,767 | A | 5/1971 | Otto | | |
| 3,726,218 | A | 4/1973 | Austin | | |
| 3,756,155 | A * | 9/1973 | Smith | F42B 7/04 | 102/455 |
| 3,952,659 | A * | 4/1976 | Sistino | F42B 7/046 | 102/501 |
| 4,610,205 | A | 9/1986 | Bentley | | |
| 4,996,924 | A * | 3/1991 | McClain | F42B 10/24 | 102/438 |
| 5,020,438 | A * | 6/1991 | Brown | F42B 10/04 | 102/501 |
| 5,713,981 | A * | 2/1998 | Amick | B22F 1/148 | 75/340 |

(Continued)

FOREIGN PATENT DOCUMENTS

| | | |
|---|---|---|
| EM | 002074633-0001 | 9/2012 |
| EM | 002382937-0002 | 1/2014 |

(Continued)

*Primary Examiner* — John Cooper
(74) *Attorney, Agent, or Firm* — Reed Smith LLP; Matthew P. Frederick; Travis J. Sumpter

(57) ABSTRACT

Shot projectiles are disclosed that are not completely spherical. The shot has an equatorial ring, top and bottom poles, and one or more sections extending between the ring and the respective poles. The ring defines a vertical height relative to an overall diameter of the projectile. The one or more sections provide flat, concave, or convex surfaces.

20 Claims, 7 Drawing Sheets

(56) References Cited

U.S. PATENT DOCUMENTS

| | | | | |
|---|---|---|---|---|
| 5,747,724 | A * | 5/1998 | Lindgren | B22F 1/17 102/459 |
| 5,798,478 | A | 8/1998 | Beal | |
| 5,831,188 | A * | 11/1998 | Amick | B22F 1/09 102/517 |
| 6,955,125 | B1 | 10/2005 | Mazzei et al. | |
| 6,959,648 | B2 | 11/2005 | Piela et al. | |
| 7,503,260 | B2 | 3/2009 | Kapeles | |
| D633,166 | S * | 2/2011 | Richardson | D22/116 |
| 8,122,832 | B1 * | 2/2012 | Wei | F42B 10/00 102/501 |
| D683,419 | S | 5/2013 | Rebar | |
| 8,622,000 | B2 * | 1/2014 | Meyer | F42B 7/046 102/448 |
| D732,635 | S | 6/2015 | Riley et al. | |
| D764,624 | S | 8/2016 | Masinelli | |
| D773,008 | S * | 11/2016 | Meyer | D22/116 |
| 9,541,362 | B2 | 1/2017 | Kraft et al. | |
| D780,282 | S | 2/2017 | Riley | |
| D781,993 | S | 3/2017 | Schultz | |
| D782,601 | S | 3/2017 | Riley | |
| D782,602 | S | 3/2017 | Riley | |
| 9,746,296 | B2 | 8/2017 | Kraft et al. | |
| 10,317,178 | B2 | 6/2019 | Burkart et al. | |
| 10,323,918 | B2 * | 6/2019 | Menefee, III | F42B 7/10 |
| 10,386,164 | B2 | 8/2019 | Polovnev | |
| 2008/0141892 | A1 * | 6/2008 | Kempf | F42B 12/74 102/502 |
| 2009/0114113 | A1 * | 5/2009 | Poore | F42B 7/046 102/460 |
| 2011/0185936 | A1 * | 8/2011 | Richardson | F42B 12/36 102/438 |
| 2012/0204708 | A1 * | 8/2012 | Pearson | F42B 33/00 29/592 |
| 2012/0234199 | A1 * | 9/2012 | Meyer | F42B 5/025 102/501 |
| 2013/0263754 | A1 * | 10/2013 | Neme | F42B 10/24 102/517 |
| 2019/0154421 | A1 * | 5/2019 | Amick | F42B 10/38 |
| 2019/0323805 | A1 | 10/2019 | Taylor et al. | |

FOREIGN PATENT DOCUMENTS

| | | |
|---|---|---|
| EM | 002624395-0001 | 3/2015 |
| EM | 005303351-0001 | 7/2018 |
| EM | 007412523-0001 | 1/2020 |
| EP | 0975930 B1 | 3/2003 |
| EP | 1368612 B1 | 7/2005 |
| EP | 1999429 B1 | 4/2014 |
| EP | 3187817 A2 | 7/2017 |

* cited by examiner

MULTI-FACETED SHOT

CROSS REFERENCE TO RELATED APPLICATION

This application is a continuation of U.S. patent application Ser. No. 17/162,848 filed Jan. 29, 2021, the entire contents of which are incorporated herein by reference.

FIELD OF THE INVENTION

The present invention generally relates to projectiles, particularly shotshell pellets, for use in a shotgun.

BACKGROUND OF THE INVENTION

Exemplary embodiments disclosed herein relate to shotshell pellets (also referred to as "shot") for a shotgun ammunition system ("cartridges" or "shotshells"). Shotshells are typically filled with shotshell pellet of a uniform size, classified according to the nominal diameter of the pellet along with the material (e.g., lead, steel, non-toxic alloys, and the like) and the intended target. Standard sizes have developed for different intended targets, for example ranging from 000 buckshot (0.36 inch (in.) diameter) to 5 (0.12 in. dia.) or 6 (0.11 in. dia.) to 9 (0.08 in. dia.) and smaller shots. Typically, a plurality of such shotshell pellets are loaded in a shotshell comprising a casing defining an internal chamber that also includes propellant and a primer.

SUMMARY OF THE INVENTION

A pellet for use in a shotshell for a shotgun comprises a top pole, a bottom pole, an equator, a plurality of sections extending between the poles and equator, and a ring at the equator.

A feature and benefit of embodiments is a projectile for shotshell in a shotgun comprising a top pole, a bottom pole, and a body. The top pole and the bottom pole are equidistant from a vertical center of the projectile and defining a vertical axis extending through the top pole and the bottom pole. The body defines an exterior surface and a vertical diameter from the top pole to the bottom pole, the body comprising: an equator about which the body is substantially symmetric; a plurality of upper sections of the exterior surface extending between the equator and the top pole and defining a first upper corner at an intersection with the tope pole; a plurality of lower sections of the exterior surface extending between the equator and the bottom pole and defining a first lower corner at an intersection with the bottom pole; and a ring protruding from the equator of the body, the ring comprising a vertical ring height comprising about 33-36% of the vertical diameter of the body. The body is flattened at the top pole and the bottom pole, the top and bottom poles being substantially circular and delineated respectively by the first upper corner and the first lower corner. The plurality of upper sections, when viewed in cross-section, comprises two or more upper sections formed as substantially flat walls disposed at different angles relative to the vertical axis. The plurality of lower sections, when viewed in cross-section, comprises two or more lower sections formed as substantially flat walls disposed at different angles relative to the vertical axis.

In embodiments, the plurality of upper sections are substantially frustoconical and the plurality of lower sections are substantially frustoconical.

In embodiments, the body further comprises a plurality of corners at intersections of the plurality of upper sections and a plurality of corners at intersections of the plurality of lower sections.

In embodiments, the ring defines a horizontal diameter; and wherein the plurality of corners encircle the vertical axis defining diameters within a range from about 15% to about 85% of the horizontal diameter.

In embodiments, the ring defines a horizontal diameter, and wherein the plurality of corners encircle the vertical axis to define: a first circle comprising a diameter within a range of about 15-25% of the horizontal diameter; a second circle comprising a diameter within a range of about 55-65% of the horizontal diameter; and a third circle comprising a diameter within a range of about 75-85% of the horizontal diameter.

In embodiments, the plurality of corners encircle the vertical axis to define: a first circle comprising a diameter within a range of about 0.020"-0.030"; a second circle comprising a diameter within a range of about 0.075"-0.085"; and a third circle comprising a diameter within a range of about 0.100"-0.120".

In embodiments, the ring encircles and is substantially symmetric about the equator of the body.

In embodiments, the vertical ring height is about 21% to 35% of the vertical diameter of the body.

In embodiments, the ring vertical height is within a range of about 0.019"-0.039"; and the body vertical diameter is within a range of about 0.090"-0.120".

In embodiments, the ring defines a horizontal diameter that is greater than the vertical height of the body.

In embodiments, the body is flattened at the top pole and the bottom pole and the vertical height is less than a horizontal diameter of the body at the equator.

A feature and benefit of embodiments is an ammunition projectile comprising a top pole, a bottom pole, and a body. The top pole and the bottom pole are equidistant from a center of the ammunition projectile and defining a vertical axis extending through the top pole and the bottom pole. The body defines an exterior surface and a vertical diameter from the top pole to the bottom pole, the exterior surface comprising: a generally flat top section at the top pole; a generally flat bottom section at the bottom pole; an equator; a ring protruding from the equator and defining a horizontal diameter that is greater than the vertical height of the body, the ring encircling and substantially symmetric about the equator; one or more upper sections of the exterior surface extending between the ring and the top section and defining varying distances from the center; and one or more lower sections of the exterior surface extending between the ring and the bottom section and defining varying distances from the center.

In embodiments, the ring has a vertical ring height comprising greater than 25% of the vertical diameter of the body.

In embodiments, the ring has a vertical ring height of about 26% to 35% of the vertical diameter of the body.

In embodiments, the ring vertical height is within a range of about 0.019"-0.039"; and the body vertical diameter is within a range of about 0.090"-0.120".

In embodiments, the one or more upper sections, when viewed in cross-section, comprise two or more upper sections formed as substantially flat walls disposed at different angles relative to the vertical axis and defining a plurality of corners at intersections of the two or more upper sections.

In embodiments, the ring defines a horizontal diameter; and wherein the plurality of corners encircle the vertical axis defining diameters within a range from about 15% to about 85% of the horizontal diameter.

In embodiments, the ring defines a horizontal diameter, and wherein the plurality of corners encircle the vertical axis to define: a first circle comprising a diameter within a range of about 15-25% of the horizontal diameter; a second circle comprising a diameter within a range of about 55-65% of the horizontal diameter; and a third circle comprising a diameter within a range of about 75-85% of the horizontal diameter.

In embodiments, the one or more upper sections, when viewed in cross-section, comprise two or more upper sections formed as curved walls with different radii; and the one or more lower sections, when viewed in cross-section, comprise two or more lower sections formed as curved walls with different radii.

In embodiments, the body further comprises an inflection point between sections of the one or more upper sections and an inflection point between sections of the one or more lower sections.

A feature and benefit of embodiments is an ammunition projectile comprising a body, a ring, and sides. The body comprises a top pole comprising a substantially flat disc, a bottom pole comprising a substantially flat disc, and an equator. The ring protrudes from the equator of the body, comprising a ring height comprising about 28%-40% of the vertical diameter of the body. The sides form an interrupted surface between the ring and at least one of the top pole and the bottom pole.

In embodiments, the sides comprise a plurality of upper sections that are substantially frustoconical and a plurality of lower sections that are substantially frustoconical.

In embodiments, the sides further comprise a plurality of corners at intersections a plurality of upper sections and a plurality of corners at intersections of a plurality of lower sections.

In embodiments, the body defines a vertical diameter along a vertical axis from a top pole to a bottom pole and the ring defines a horizontal diameter; and the plurality of corners encircle a vertical axis defining diameters within a range from about 15% to about 85% of the horizontal diameter.

In embodiments, the plurality of corners encircle the vertical axis to define: a first circle comprising a diameter within a range of about 15-25% of the horizontal diameter; a second circle comprising a diameter within a range of about 55-65% of the horizontal diameter; and a third circle comprising a diameter within a range of about 75-85% of the horizontal diameter.

In embodiments, the plurality of corners encircle the vertical axis to define: a first circle comprising a diameter within a range of about 0.020"-0.030"; a second circle comprising a diameter within a range of about 0.075"-0.085"; and a third circle comprising a diameter within a range of about 0.100"-0.120".

In embodiments, the ring encircles and is substantially symmetric about the equator of the body.

In embodiments, the body defines a vertical diameter along a vertical axis from a top pole to a bottom pole and the ring defines a horizontal diameter; and the vertical ring height is about 21% to 35% of the vertical diameter of the body.

In embodiments, the body defines a vertical diameter along a vertical axis from a top pole to a bottom pole and the ring defines a horizontal diameter; and further comprising: the ring vertical height is within a range of about 0.019"-0.039"; and the body vertical diameter is within a range of about 0.090"-0.120".

In embodiments, the body defines a vertical diameter along a vertical axis from a top pole to a bottom pole and the ring defines a horizontal diameter that is greater than the vertical height of the body.

In embodiments, the body defines a vertical diameter along a vertical axis from a top pole to a bottom pole and the ring defines a horizontal diameter; and the body is flattened at the top pole and the bottom pole and the vertical height is less than a horizontal diameter of the body at the equator.

In embodiments, the sides comprise a plurality of upper sections that, when viewed in cross-section, are formed as curved walls with different radii.

In embodiments the sides comprise a plurality of lower sections that, when viewed in cross-section, are formed as curved walls with different radii.

In embodiments, the sides comprising an inflection point between sections of the sides.

The above summary of the various representative embodiments of the invention is not intended to describe each illustrated embodiment or every implementation of the invention. Rather, the embodiments are chosen and described so that others skilled in the art can appreciate and understand the principles and practices of the invention. The Figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1:
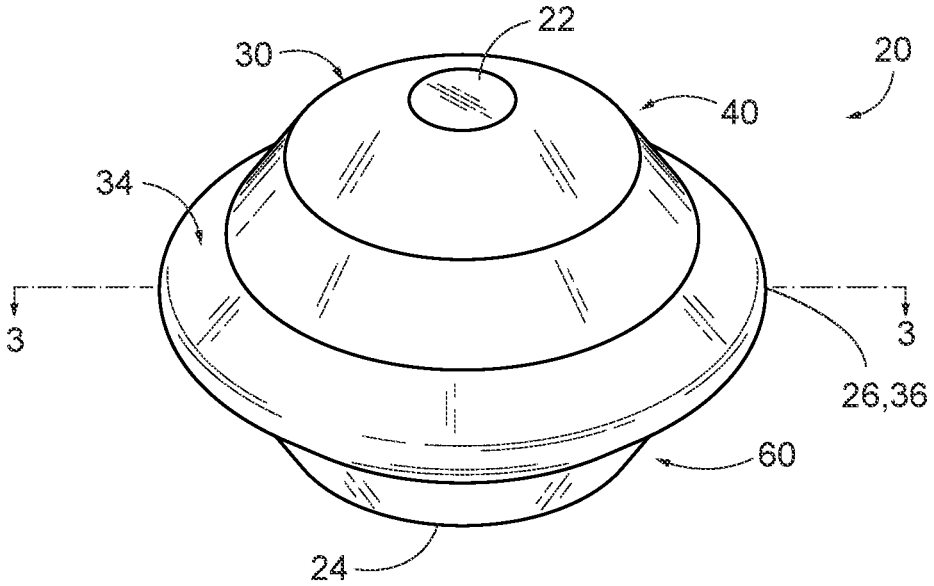
FIG. 1 is a front perspective view of a shotgun projectile in accord with embodiments of the present disclosure.

While the invention is amenable to various modifications and alternative forms, specifics thereof have been depicted by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Figure 2:
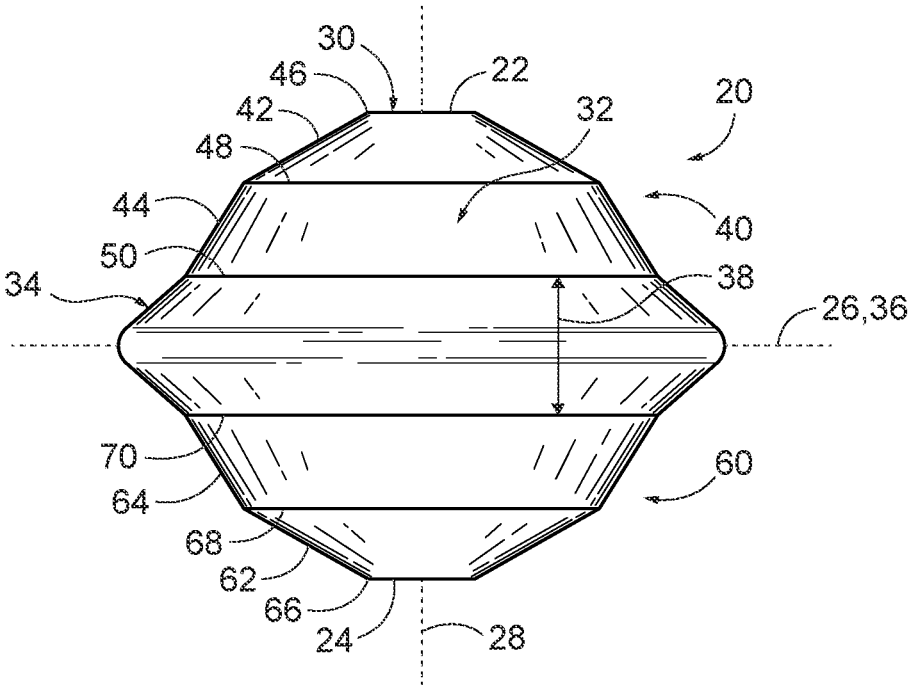
FIG. 2 is a side elevation view of the shotgun projectile of FIG. 1.

FIGS. 1-2 show a projectile 20 constructed in accordance with embodiments of the invention. In some embodiments, the projectile 20 comprises a top pole 22 and a bottom pole 24 that are generally or substantially flat disc-like sections. The top pole 22 and the bottom pole 24 are substantially equidistant from a vertical center 26 and that define a vertical axis 28 through the top and bottom poles 22, 24. In other embodiments, the projectile 20 also includes a body 30 defining an exterior surface 32 and having a ring 34, one or more upper sections 40, and one or more lower sections 60. The ring 34 protrudes from an equator 36 about which the body 30 may be substantially symmetric, i.e., divided into upper and lower hemispheres. The ring 34 also defines a vertical ring height 38.

The one or more upper sections 40 extend between the equator 36 and the top pole 22. In certain embodiments, a plurality of upper sections 40 are provided that, when viewed in cross-section (FIGS. 3A and 3B), are defined by first and second walls 42, 44 that are substantially flat and are disposed at different angles relative to the vertical axis 28. Any number of walls is contemplated, including embodiments with one, two, three, four, or more walls defining the one or more upper sections 40. The body 30 of the projectile 20 defines a plurality of corners between sections, the plurality of corners being angular and including a first corner 46 between the top pole 22 and the first wall 42, a second corner 48 between the first wall 42 and the second wall 44, and a third corner 50 between the second wall 44 and the ring 34. Each of the one or more upper sections 40 defines a substantially frustoconical shape. In certain embodiments shown in FIG. 4, each of the first corner 46, second corner 48, and third corner 50 defines a substantially circular shape about the vertical axis 28. In a general sense, the plurality of upper sections 40 and the plurality of lower sections 60 constitute sides forming interrupted surfaces between the ring 34 and the respective the top pole 22 and bottom pole 24. The body 30 is interrupted in the upper sections 40 by the first wall 42 and the second wall 44 extending at different angles relative to the vertical axis 28, forming angular steps that define the first corner 46, second corner 48, and third corner 50. Likewise the body 30 is interrupted in the lower sections 60 by the first wall 62 and the second wall 64 extending at different angles relative to the vertical axis 28, forming angular steps that define the first corner 66, second corner 58, and third corner 70.

The one or more lower sections 60 extend between the equator 36 and the bottom pole 24. In some embodiments, a plurality of lower sections 60 are provided that, when viewed in cross-section (FIGS. 3A and 3B), are defined by first and second walls 62, 64 that are substantially flat and are disposed at different angles relative to the vertical axis 28. Any number of walls is contemplated, including embodiments with one, two, three, four, or more walls defining the one or more lower sections 60. The body 30 of the projectile defines a plurality of corners or inflection points between walls and poles, including a first corner 66 between the bottom pole 24 and the first wall 62, a second corner 68 between the first wall 62 and the second wall 64, and a third corner 70 between the second wall 64 and the ring 34. In certain embodiments similar to the upper section 40 shown in FIG. 4, each of the first corner 66, second corner 68, and third corner 70 defines a substantially circular shape about the vertical axis 28.

Figure 3A:
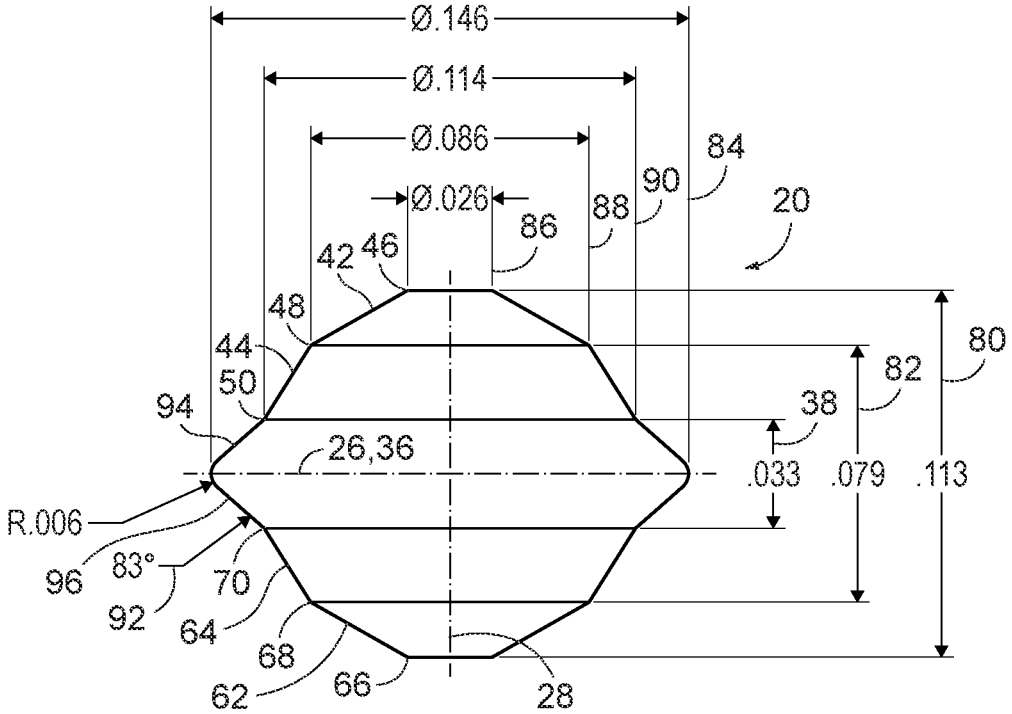
FIG. 3A is a side cross-sectional view of the shotgun projectile of FIG. 1 taken along the line 3-3 in FIG. 1 in accord with a #5 shot embodiment of the present disclosure.
Figure 3B:
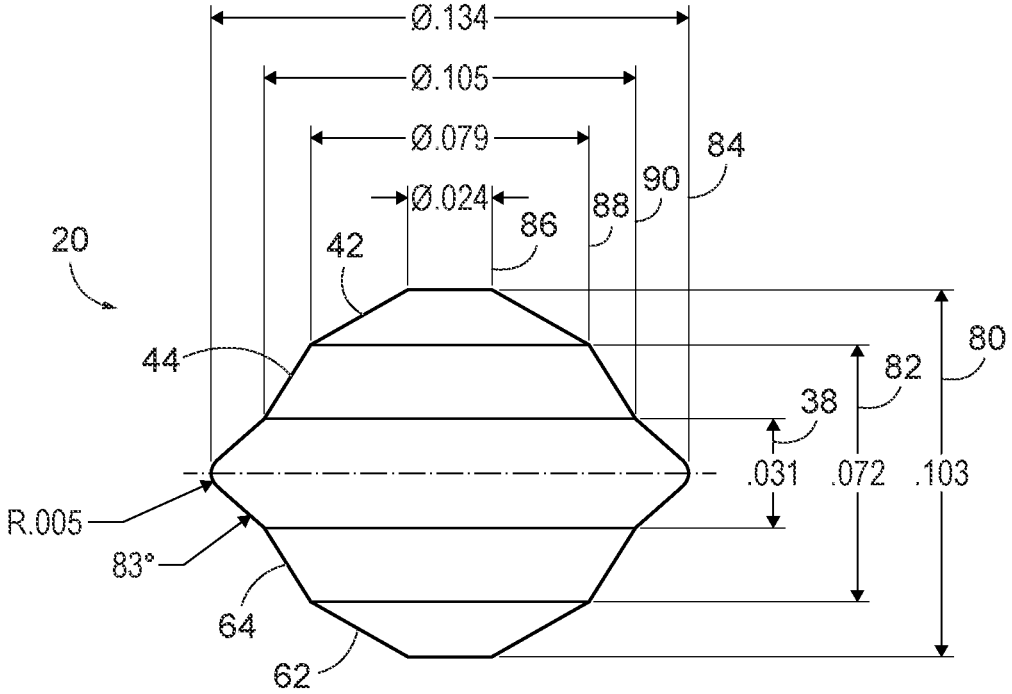
FIG. 3B is a side cross-sectional view of the shotgun projectile of FIG. 1 taken along the line 3-3 in FIG. 1 in accord with a #6 shot embodiment of the present disclosure.
Figure 4:
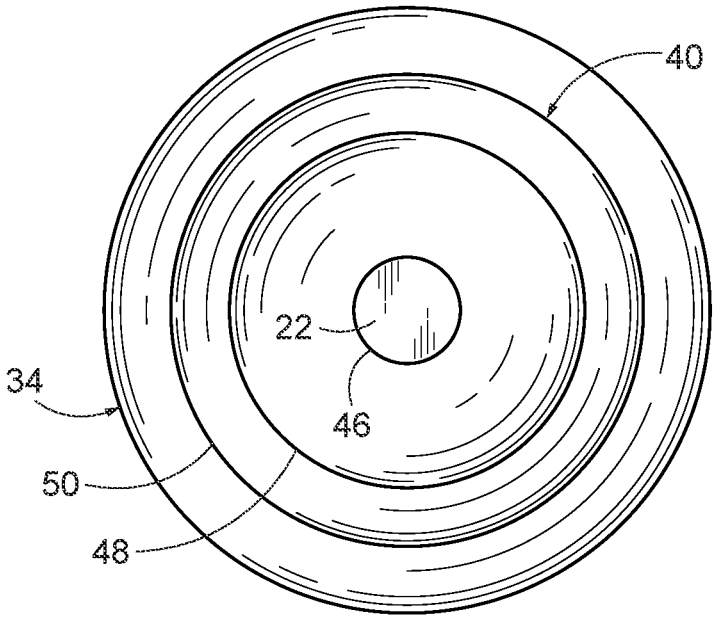
FIG. 4 is a top view of the shotgun projectile of FIG. 1.

FIGS. 3A and 3B illustrate how embodiments of the present disclosure provide a multi-faceted shot that is not spherical. The projectile 20 has several stepped surfaces including the frustoconical walls 42, 44, 62, 64, such surfaces together providing angular steps between the ring 34 and the poles 22, 24. Likewise the top and bottom poles 22, 24 are flat sections. The embodiment of FIGS. 1-4 provides a multi-faceted exterior surface 32 and does not include any three-dimensionally curved surfaces that could define a portion of a sphere, let alone any such curved surfaces across a majority of the exterior surface 32 of the projectile 20.

FIG. 3A shows particular dimensions for the projectile 20 applicable to embodiments of the present disclosure. The illustrated projectile 20 is in the class of a #5 birdshot (0.12 in. diameter). It will be appreciated that various other sizes are contemplated while maintaining similar relative dimensions of the constituent parts of the projectile 20. These dimensions include the ring height 38, a vertical diameter 80, a second corner height 82, a horizontal diameter 84 for the ring 34 at the equator 36, a pole diameter 86 (also considered a first circle diameter 86), a second circle diameter 88, and a third circle diameter 90. The ring 34 also defines a ring angle 92 measured between an upper wall 94 and a lower wall 96 of the ring 34. The ring angle may be about 83 degrees, about 80-90 degrees, or about 75-95 degrees.

In the embodiment of FIG. 3A, the vertical diameter 80 and third circle diameter 90 are 101% and 102%, respectively, of the standard 0.12 in. diameter for a #5 shot. Although the projectile 20 is not spherical, these dimensions define the closest analogue in standard spherical shots, allowing for similar uses (e.g., hunting similar game as with the corresponding standard). In embodiments, the horizontal diameter 84 is appreciably larger and constitutes 130% of the standard diameter, which produces the ring 34, that projects out from the more "standard" dimension of a #5 shot (or another size shot). In other words, the ring 34 projects out substantially further than the dimensions 80, 90 that more closely correspond to a standard sized shot. More generally, embodiments applicable to the present disclosure may have vertical and third circle diameters 80, 90 within about 95%-105% of the standard diameter of a given shot size, or within about 90%-110% of such standard diameter. Table 1 below provides a partial list of standard shot dimensions applicable to the present invention. It will be appreciated that the sizes noted below are representative standards; however, other organizations or individual manufacturers may use different sizes. The present invention is applicable to any such size even if not explicitly listed in Table 1.

TABLE 1

Selected Standard Shot Dimensions

| American Size | English Size | European Size | Pellet Diameter (in.) |
|---|---|---|---|
| 000 | — | — | 0.36 |
| 00 | — | — | 0.34 |
| 0 | — | — | 0.32 |
| #1 Buck | — | — | 0.30 |
| #3 Buck | — | — | 0.25 |
| #4 Buck | — | — | 0.24 |
| F | — | — | 0.22 |
| T | — | — | 0.20 |
| BBB | BBB | — | 0.19 |
| BB | BB | — | 0.18 |
| 1 | B | 1 | 0.16 |
| 2 | 1 | 2 | 0.15 |
| 3 | 2 | 3 | 0.14 |
| 4 | 3 | 4 | 0.13 |

TABLE 1-continued

| Selected Standard Shot Dimensions | | | |
|---|---|---|---|
| American Size | English Size | European Size | Pellet Diameter (in.) |
| 5 | 4 | 5 | 0.12 |
| 6 | 5 | 6 | 0.11 |
| 7 | 6 | 7 | 0.10 |
| 7½ | 6½ | — | 0.095 |
| 8 | 7 | 8 | 0.09 |
| 8½ | 8 | — | 0.085 |
| 9 | 9 | 9 | 0.08 |
| 9½ | — | — | 0.075 |
| 10 | 10 | 10 | 0.07 |

The other dimensions shown in FIG. 3A may be derived and implemented as a function of the vertical diameter 80 and/or the third circle diameter 90. Notably, in embodiments the vertical ring height 38 measured relative to either the vertical diameter 80 or the third circle diameter 90 may be more than 20%, 26-50%, 30-40%, about 29-31%, or about 33-36%. As such, Table 1 below shows dimensions expressed as a function of another determined dimension. Additionally, the last column in Table 2 lists measured dimensions for manufactured prototypes of the #5 shot of FIG. 3A.

TABLE 2

| Relative Dimensions and Prototype #5 Shot Dimensions | | | | |
|---|---|---|---|---|
| Dimension | Relative to Standard Diameter | Relative to Vertical Diameter | Relative to Horizontal Diameter | Manufactured Size Range for #5 Shot Embodiment of This Invention |
| Vertical Diameter 80 | 90-110% | — | 70-100% | 0.111 ± .002 in. |
| Horizontal Diameter 84 | 100-140% | 100-140% | — | 0.148 ± .002 in. |
| Pole Diameter 86 | — | 20-35% | 15-25% | 0.037 ± .005 in. |
| Second Circle Diameter 88 | — | 70-80% | 55-65% | 0.084 ± .001 in. |
| Third Circle Diameter 90 | 90-110% | 90-110% | 70-100% | 0.116 ± .002 in. |
| Ring Height 38 | — | 21-50% | 15-35% | 0.0396 ± .010 in. |
| Second Corner Height 82 | — | 65-80% | 50-60% | 0.083 ± .010 in. |

The variability in dimensions shown above in the last column of Table 1 is due to various manufacturing tolerances, tooling precision, material variability (e.g. degree of compaction of powdered material before pressing), and the like. Accordingly, in these manufactured embodiments the ratio of the vertical ring height 38 to the vertical diameter 80 ranges from 35-36% and the ratio of the vertical ring height 38 to the horizontal diameter 84 ranges from 33-35%. Additionally, the ring angle 92 in these manufactured embodiments can range from about 85-93 degrees.

FIG. 3B shows particular dimensions for the projectile 20 applicable to certain embodiments of the present disclosure in the class of a #6 birdshot (0.11 in. diameter). It will be appreciated that the relative dimensions in this embodiment correspond to the ranges of values in Table 1 above. For example, the illustrated vertical diameter 80 and third circle diameter 90 are 94% and 95%, respectively, of the standard 0.11 in. diameter for a #6 shot.

In certain embodiments, shot as described above can be formed from various selected materials including lead, steel, tungsten, alloys thereof, green materials, or the like.

In certain embodiments, shot 20 as described herein can be made from powder components and be formed using a powder press. The powder press comprises a lower hemispherical cavity, an upper hemispherical cavity and a plate in between the two cavities comprising a central ring-shaped opening. The ring-shaped opening may be cylindrical or may have other desired shapes to form the equatorial ring 34 on the projectile 20 having a shape described above. Powder components placed in the cavities within the ring may be combined with lubricants and/or binders and are pressed to the desired shape.

In embodiments, the shot 20 described above may be sintered. For a sintered shot, the equatorial ring 34 may be made larger for ease of manufacture. For example, for a 3 to 5 mm diameter high density shot, the ring height 38 may be between about 40-45% of the vertical height 80. For a 5 mm sintered shot, the band can be made between about 2.0 mm and 2.25 mm in its width. For a sintered shot larger than about 5 mm, the ring height 38 in some embodiments can be reduced to about 25-30% of the vertical height 80.

In other embodiments, shot as disclosed may be manufactured using a ball header process. Ball header machines are particularly suitable for forming steel shot. For example, a steel wire may be fed into the header, the wire having a diameter smaller than the desired diameter of the final shot. The header will cut the wire, and two heading cavities will be pressed toward the ends of the wire. By adjusting the pressure applied by the header, shot having the shapes described above may be formed, particularly with the desired shape and size of the ring 34. The ring 34 is desirably formed between the two heading cavities beyond the edges of the two cavities.

Embodiments of the shot described above advantageously improve the manufacturing, aerodynamics, ballistics, and terminal performance of the shot. The disclosed embodiments are readily adaptable to high-volume and low-cost manufacturing processes, such as those discussed above. For an example of ballistic improvement, in a method of using the shot, a user may fire a shotgun shell including the shots (projectiles) as described above. When the shot impacts the desired target, the equatorial ring 34 and/or the corners 46, 48, 50, 66, 68, 70 provide cutting surfaces for increased penetration. Aerodynamically, the ring 34 and overall shape may affect the trajectory of the shots, which can desirably improve the spray size and/or consistency, velocity, and/or distance of the shot traveling to the target.

Figure 5:
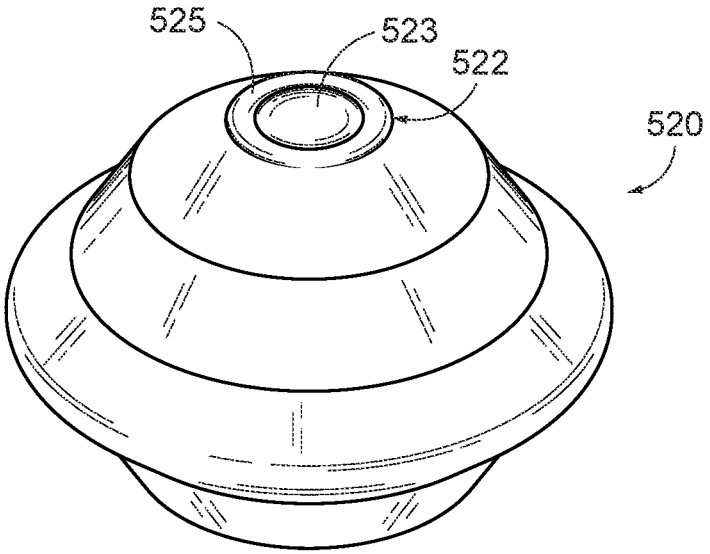
FIG. 5 is a front perspective view of a shotgun projectile in accord with embodiments of the present disclosure.

In certain embodiments shown in FIG. 5, a projectile 520 includes top pole 522 and a bottom pole (not shown) that are arranged with a depressed circular surface 523 inside an outer ring 525. The outer ring may be a flat frustoconical surface, a concave surface, or a convex surface. The depressed circular surface 523 may be substantially flat, convex, or concave.

Figure 6:
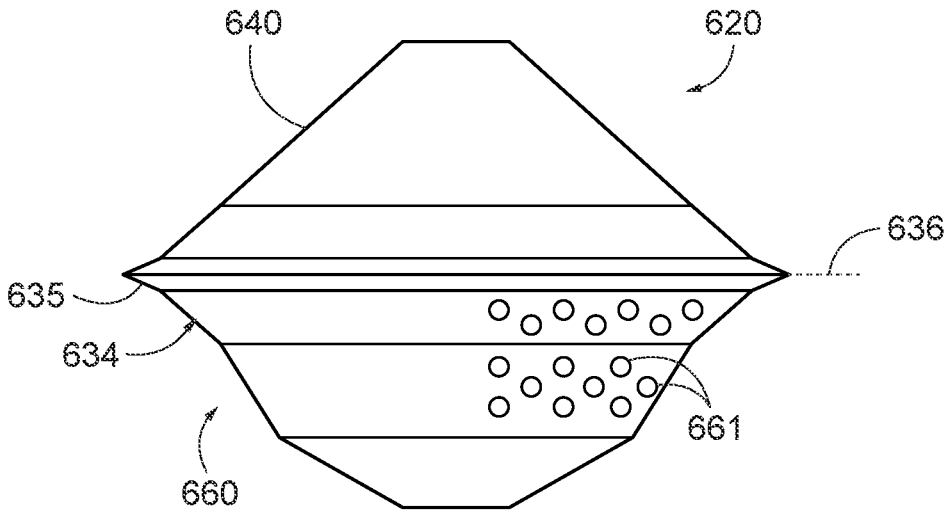
FIG. 6 is a side view of a shotgun projectile in accord with embodiments of the present disclosure.

FIGS. 6-9 show a variety of alternative embodiments applicable to the present disclosure. One or more of the illustrated features may be applicable to any other disclosed embodiment in part or in whole, including the embodiments of FIGS. 1-3 and 5. It will be appreciated that these features may affect certain dimensions listed in Table 2 without significantly affecting the ring height 38, vertical height 80, second corner height 82, first circle diameter 86, and the horizontal diameter 84. FIG. 6 shows an embodiment of a projectile 620 comprising a top pole 602 and a single upper section 640 extending to a ring 634. A ring 635 has an angular waist 635 at an equator 636. In other embodiments, a lower section 660 has a plurality of dimples 661 for improving aerodynamics.

Figure 7:
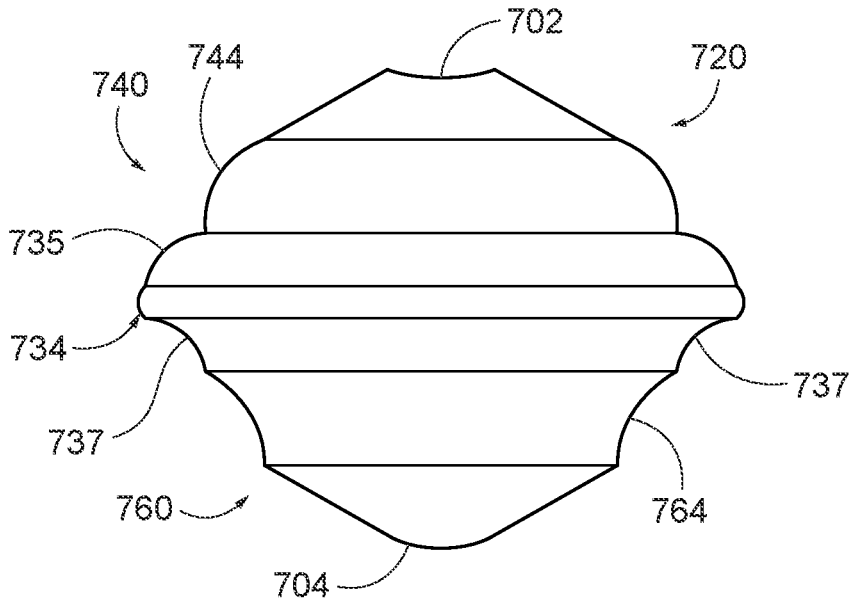
FIG. 7 is a side view of a shotgun projectile in accord with embodiments of the present disclosure.

FIG. 7 shows an embodiment of a projectile 720 comprising poles and walls that are curved concave or convex, such as a concave top pole 702 and a concave wall 764 of a plurality of lower sections 760. The shot may include a convex bottom pole 704 or a convex wall 744 of a plurality of upper sections 740. A ring 734 may likewise have a convex portion 735 or a concave portion 737 formed therein. These various curved surfaces may be defined by different radii of curvature or substantially equal radii of curvature. Likewise it will be appreciate that curved inflection points may be provided between the poles and walls or between the walls and ring may be provided in lieu of the corners shown in other embodiments.

Figure 8:
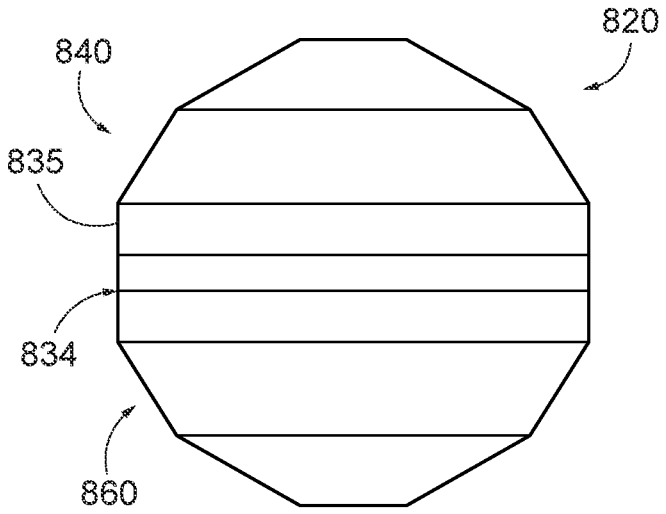
FIG. 8 is a side view of a shotgun projectile in accord with embodiments of the present disclosure.

FIG. 8 shows an embodiment of a projectile 820 with a ring 834 defined by a substantially vertical wall 835 extending between a plurality of upper sections 840 and a plurality of lower sections 860, resulting in a substantially 12-sided cross-sectional form. This embodiment may result in a reduced horizontal diameter compared to other embodiments.

Figure 9:
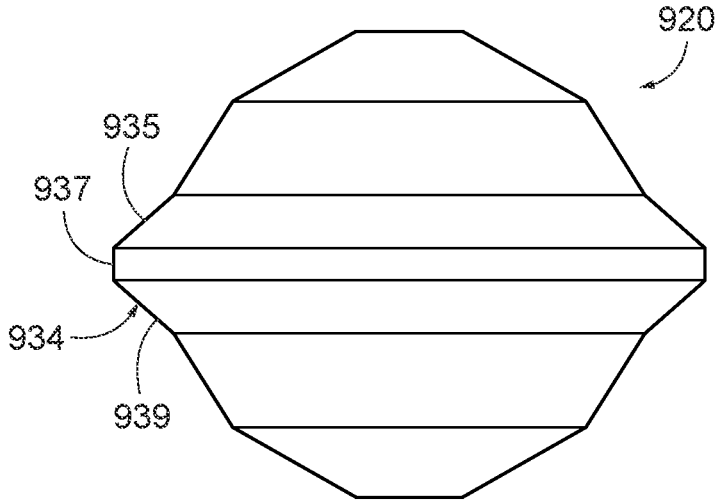
FIG. 9 is a side view of a shotgun projectile in accord with embodiments of the present disclosure.

FIG. 9 shows an embodiment of a projectile 920 comprising a ring 934 formed of substantially flat walls 935, 937, and 939.

Figure 10:
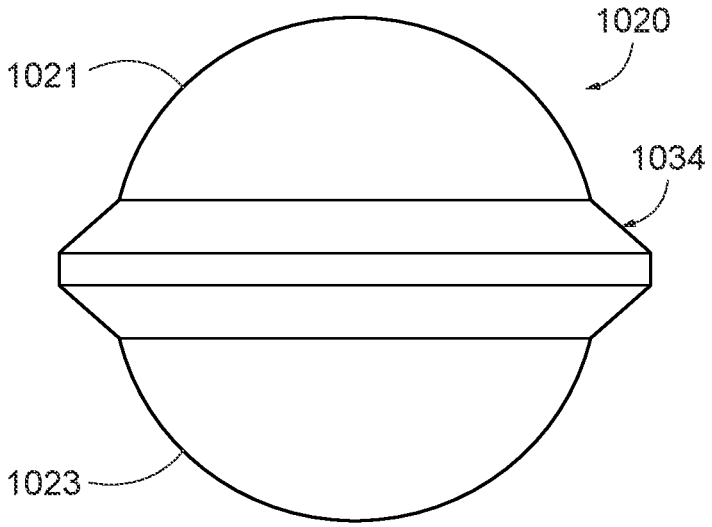
FIG. 10 is a side view of a shotgun projectile in accord with embodiments of the present disclosure.

FIG. 10 shows an embodiment of a projectile 1020 comprising a ring 1034 that is substantially similar to the ring 34 of FIGS. 1-4. In this embodiment, a substantially spherical upper hemisphere 1021 and a substantially spherical lower hemisphere 1023 extend from the ring 1034, providing a rounded shape without the corners or substantially flat walls and poles of other embodiments.

Figure 11:
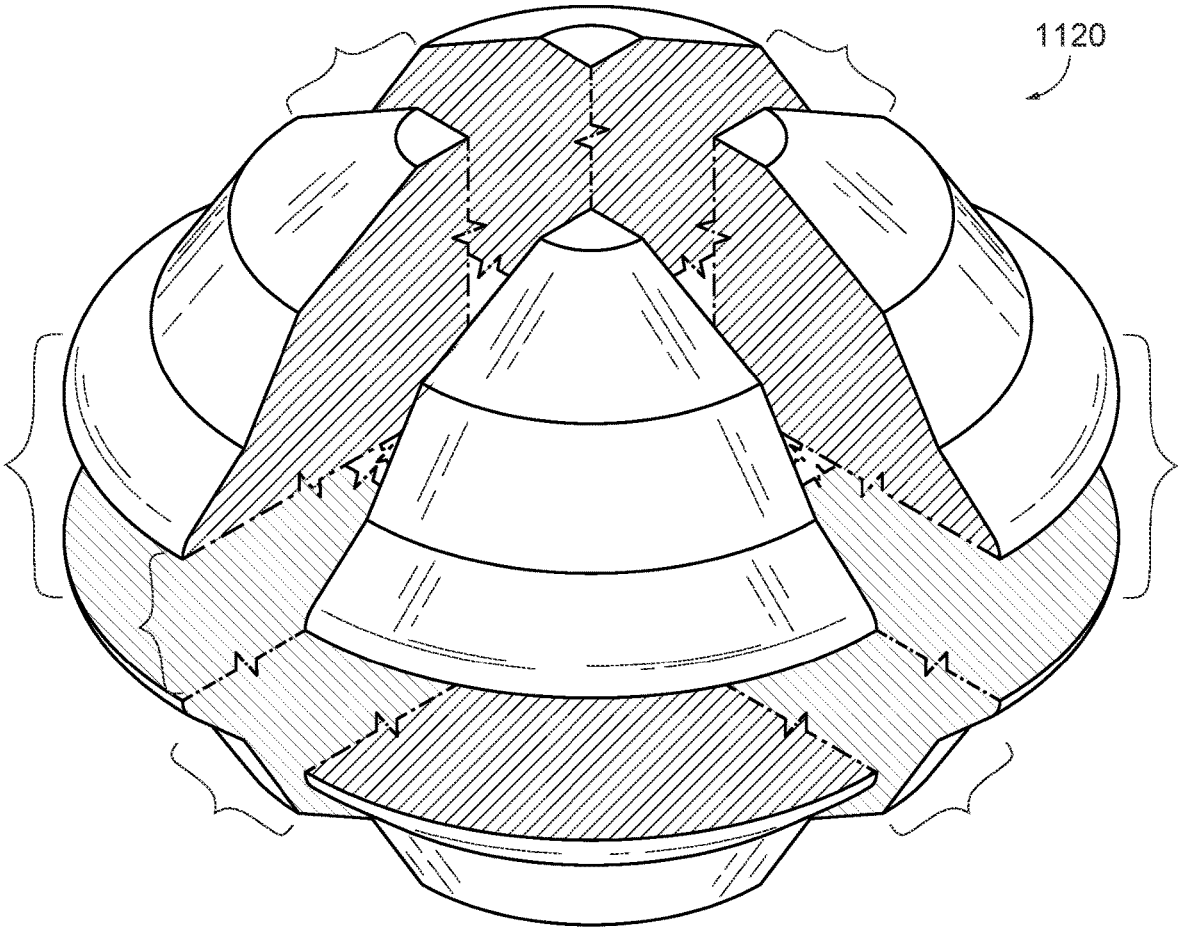
FIG. 11 is a perspective view of a shotgun projectile in accord with embodiments of the present disclosure.

FIG. 11 shows an embodiment of a projectile 1120 shown in an exploded view that is similar to the projectile 20 of FIGS. 1-4. However, in this embodiment, the illustrated brackets indicate areas of selectably variable or indeterminate length formed of the same material as the rest of the projectile and otherwise having substantially the same profile. In this manner, the projectile may be longer or shorter in horizontal and/or vertical directions as indicated by the brackets. Such variations in length may result in the projectile 1120 being oblong in either the vertical or horizontal direction.

All of the features disclosed and claimed, and all of the steps of any method or process so disclosed, may be combined in any combination, except combinations where at least some of such features and/or steps are mutually exclusive. Each feature disclosed in this specification may be omitted or replaced by alternative features serving the same, equivalent or similar purpose, unless expressly stated otherwise. Certain features may sometimes be used to advantage without a corresponding use of other features. Thus, unless expressly stated otherwise, each feature disclosed is an example only of a generic series of equivalent or similar features. Inventive aspects of this disclosure are not restricted to the details of the foregoing embodiments, but rather extend to any novel embodiment, or any novel combination of embodiments, of the features presented in this disclosure, and to any novel embodiment, or any novel combination of embodiments, of the steps of any method or process so disclosed.

Although specific examples have been illustrated and described herein, it will be appreciated by those of ordinary skill in the art that any arrangement calculated to achieve the same purpose could be substituted for the specific examples disclosed. In particular, although embodiments corresponding to #5 or #6 shot are detailed herein, shotshell projectiles applicable to the present invention are considered to provide similar benefits and performance for any size and application. This disclosure is intended to cover adaptations or variations of the present subject matter. Alternative features shown in FIGS. 4-10 may incorporated in whole or in part (e.g., in only one hemisphere) for embodiments of the present disclosure. Applicants intend to embrace all such alternatives, modifications, equivalents, and variations that are within the spirit and scope of the exemplary embodiments. Therefore, it is intended that the invention be defined by the attached claims and their legal equivalents, as well as the illustrative aspects. The above described embodiments are merely descriptive of its principles and are not to be considered limiting. Further modifications of the invention herein disclosed will occur to those skilled in the respective arts and all such modifications are deemed to be within the scope of the inventive aspects.

The invention claimed is:

1. A projectile for a shotshell, comprising:

a top pole and a bottom pole defining a vertical axis extending through the top pole and the bottom pole;

a body defining an exterior surface and a vertical diameter from the top pole to the bottom pole, the body comprising:

an equator;

a ring protruding from the equator of the body, the ring comprising a vertical ring height comprising about 33-36% of the vertical diameter of the body, an upper section of the exterior surface extending between the ring and the top pole;

a lower section of the exterior surface extending between the ring and the bottom pole; and wherein at least one of the upper section and the lower section comprises two or more sections disposed at different angles relative to the vertical axis, when viewed in cross-section.

2. The projectile of claim 1, wherein the two or more sections of the at least one of the upper section and the lower section are substantially frustoconical.

3. The projectile of claim 2, wherein the body further comprising a plurality of corners at intersections of the two or more sections of the at least one of the upper section and the lower section; and the ring defines a horizontal diameter; and wherein the plurality of corners encircle the vertical axis defining diameters within a range from about 15% to about 85% of the horizontal diameter.

4. The projectile of claim 3, wherein the ring defines a horizontal diameter, and wherein the plurality of corners encircle the vertical axis to define:

a first circle comprising a diameter within a range of about 15-25% of the horizontal diameter;

a second circle comprising a diameter within a range of about 55-65% of the horizontal diameter; and a third circle comprising a diameter within a range of about 75-85% of the horizontal diameter.

5. The projectile of claim 3, wherein the plurality of corners encircle the vertical axis to define:

a first circle comprising a diameter within a range of about 0.020"-0.030";

a second circle comprising a diameter within a range of about 0.075"-0.085"; and a third circle comprising a diameter within a range of about 0.100"-0.120".

6. The projectile of claim 1, wherein the ring encircles and is substantially symmetric about the equator of the body;

the top pole further comprises a top section comprising a surface selected from at least one of:

a substantially flat surface;

a concave surface;

a convex surface;

an outer ring encircle a concave surface;

an outer ring encircling a convex surface; and a dimpled surface; and the bottom pole further comprises a bottom section comprising a surface selected from at least one of:

a substantially flat surface;

a concave surface;

a convex surface;

an outer ring encircling a concave surface;

an outer ring encircling a convex surface; and a dimpled surface.

7. The projectile of claim 1, wherein the vertical ring height is about 21% to 35% of the vertical diameter of the body.

8. The projectile of claim 1, further comprising:

the-vertical ring height is within a range of about 0.019"-0.039"; and the vertical body diameter is within a range of about 0.090"-0.120".

9. The projectile of claim 1, wherein the ring defines a horizontal diameter that is greater than the vertical diameter of the body.

10. An ammunition projectile comprising:

a top pole and a bottom;

a body defining an exterior surface and a vertical diameter from the top pole to the bottom pole, the exterior surface comprising:

a top section at the top pole;

a bottom section at the bottom pole;

an equator;

a ring protruding from the equator and defining a horizontal diameter that is greater than the vertical diameter of the body, the ring encircling and substantially symmetric about the equator;

one or more upper sections of the exterior surface extending between the ring and the top section;

one or more lower sections of the exterior surface extending between the ring and the bottom section; and wherein at least one of the one or more upper sections and the one or more lower sections comprises two or more sections disposed at different angles relative to a vertical axis extending through the top pole and the bottom pole, when viewed in cross-section.

11. The ammunition projectile of claim 10, wherein the ring has a vertical ring height comprising greater than 25% of the vertical diameter of the body; and the top pole and the bottom pole are offset from a center of the ammunition projectile by offset distances, wherein the offset distance of the top pole is approximately equal to the offset distance of the bottom pole and wherein the offset distances are disposed along the vertical axis.

12. The ammunition projectile of claim 10, wherein the top section at the top pole and the bottom section at the bottom pole each comprises a surface selected from at least one of:

a substantially flat surface;

a concave surface;

a convex surface;

an outer ring encircling a concave surface;

an outer ring encircling a convex surface; and a dimpled surface.

13. The ammunition projectile of claim 10, further comprising:

the vertical ring height is within a range of about 0.019"-0.039"; and the vertical body diameter is within a range of about 0.090"-0.120".

14. The ammunition projectile of claim 10, wherein the two or more sections of the at least one of the upper section and the lower section, when viewed in cross-section, comprise two or more sections formed as substantially flat walls disposed at different angles relative to the vertical axis and defining a plurality of corners at intersections of the two or more sections, the ring, and the top section.

15. The ammunition projectile of claim 14, wherein the ring defines a horizontal diameter;

and wherein the plurality of corners encircle the vertical axis defining diameters within a range from about 15% to about 85% of the horizontal diameter.

16. The ammunition projectile of claim 14, wherein the ring defines a horizontal diameter, and wherein the plurality of corners encircle the vertical axis to define:

a first circle comprising a diameter within a range of about 15-25% of the horizontal diameter;

a second circle comprising a diameter within a range of about 55-65% of the horizontal diameter; and a third circle comprising a diameter within a range of about 75-85% of the horizontal diameter.

17. The ammunition projectile of claim 10, wherein the two or more sections of the at least one of the upper section and the lower section, when viewed in cross-section, comprise two or more upper sections formed as curved walls with different radii.

18. The ammunition projectile of claim 17, the body further comprising an inflection point between the two or more sections of the at least one of the one or more upper sections and the one or more lower sections.

19. An ammunition projectile comprising:

a body comprising a top pole, a bottom pole, and an equator;

a ring protruding from the equator of the body, comprising a ring height comprising about 28% -40% of a vertical diameter of the body;

sides forming an interrupted surface between the ring and at least one of the top pole and the bottom pole; and wherein the interrupted surface comprises two or more sections disposed at different angles relative to a vertical axis extending through the top pole and the bottom pole, when viewed in cross-section.

20. The ammunition projectile of claim 19, wherein:

the top pole comprises a surface selected from at least one of:

a substantially flat surface;

a concave surface;

a convex surface;

an outer ring encircling a concave surface;

an outer ring encircling a convex surface; and a dimpled surface;

the bottom pole comprises a surface selected from at least one of:

a substantially flat surface;

a concave surface;

a convex surface;

an outer ring encircling a concave surface;

an outer ring encircling a convex surface; and a dimpled surface.

* * * * *